US006053079A

United States Patent [19]

Sokol et al.

[11] Patent Number: 6,053,079

[45] Date of Patent: Apr. 25, 2000

[54] TOOL FOR MANIPULATING THREADED BALL JOINT STUD LOCATING

[75] Inventors: Gary L. Sokol, Longmont; Ted S. Golas, Westminster, both of Colo.

[73] Assignee: Ingalls Engineering Company, Inc., Longmont, Colo.

[21] Appl. No.: 09/046,082

[22] Filed: Mar. 23, 1998

[51] Int. Cl.[7] ..... B25B 23/00

[52] U.S. Cl. ..... 81/461; 81/176.1; 81/176.15

[58] Field of Search ..... 81/176.1, 176.15, 81/461, 52, 125

[56] References Cited

U.S. PATENT DOCUMENTS 1,992,474 2/1935 Currier ..... 81/445

*Primary Examiner*—Timothy V. Eley
*Assistant Examiner*—Willie Berry, Jr.
*Attorney, Agent, or Firm*—Harold A. Burdick

[57] ABSTRACT

A tool for manipulating threaded ball joint stud locating bushings at a threaded bore in an axle housing is disclosed. The tool includes a support mountable to the ball joint stud to provide stable location of an extractor assemblage receiving the support therethrough. The extractor assemblage includes portions for engaging the bushing and for securing engagement with the bushing during manipulation of the extractor assemblage to thus rotate the bushing.

15 Claims, 4 Drawing Sheets

TOOL FOR MANIPULATING THREADED BALL JOINT STUD LOCATING

FIELD OF THE INVENTION

This invention relates to vehicle alignment tools, and, more particularly, relates to tools specially adapted for manipulating, and, in particular, extracting, a threaded ball joint stud locating bushing from a threaded bore in an axle housing.

BACKGROUND OF THE INVENTION

Many four wheel drive vehicles utilize a threaded bushing to locate and hold the upper ball joint stud in the axle housing. Because of the location of the bushing, it is subject to road contamination (water, salts, dirt and the like) which causes the bushing often to be found "frozen" in place in its threaded bore, and thus quite difficult to rotate, when the need for removal or replacement arises.

Typically such ball joint stud locating bushings are provided with four slots spaced circumferentially around one end of the bushing, the slots being used to install and remove the bushing. Various tools exist which have heads corresponding to the slot configuration of such bushings (i.e., circumferentially spaced projections).

Such heretofore known tools, however, share a common impediment to their effective use: nothing is provided to maintain engagement of the tool head projections and bushing slots, or to in any other way stabilize such tools, during use. Heretofore known tools require the user to maintain contact between projections and slots by manual exertion of downward (i.e., toward the bushing end) force while rotating the tool.

Exertion of such force is quite limited and difficult in practice, since the user is operating such tools from an angle (more or less 90°) relative to the bushing end and the axis of rotation of the bushing. Because such bushings are often frozen and/or otherwise resistant to rotation in the threaded bore, during bushing extraction such heretofore known tools have had the tendency to cam themselves out of the bushing slots, thus preventing effective use of these tools. Improvements in such tools directed toward stabilizing the tool for use at the bushing could thus still be utilized.

SUMMARY OF THE INVENTION

This invention provides a tool for manipulating, at a threaded bore in an axle housing, a threaded bushing for locating a ball joint stud. The tool is adapted for stability of tool position and for maintenance of engagement between the tool and the bushing while the bushing is being rotated (extracted or installed) in the axle housing bore.

The tool includes a support adapted for stable location of the tool at the ball joint stud, and an extractor assemblage that receives the support therethrough. The extractor assemblage includes a threaded portion engagable at an external threaded surface of the support, and a bushing engaging portion rotatable relative to the support.

The support has an internal threaded surface adapted for receiving the ball joint stud thereat. The engaging portion of the extractor assemblage includes an opening for receipt therethrough of the support, and is freely rotatable relative to the support. The threaded portion is provided for securing engagement of the engaging portion and the bushing during manipulation of the bushing, the threads of the threaded portion and of the external surface of the support having a thread pitch selected to substantially match thread pitch of the threaded bushing to be extracted.

It is therefore an object of this invention to provide an improved tool for manipulating, at a threaded bore in an axle housing, a threaded bushing for locating a ball joint stud.

It is another object of this invention to provide a tool for manipulating a threaded bushing for locating a ball joint stud that is adapted for stability of tool position and for maintenance of engagement between the tool and the bushing while the bushing is being rotated.

It is still another object of this invention to provide a tool for manipulating, at a threaded bore in an axle housing, a threaded bushing for locating a ball joint stud, the tool comprising supporting means adapted for stable location at the ball joint stud and having a threaded portion, engaging means configured for engagability with the threaded bushing and having an opening for receipt therethrough of the supporting means, and securing means having a threaded portion engagable with the threaded portion of the supporting means for securing engagement of the engaging means with the threaded bushing during manipulation of the threaded bushing.

It is yet another object of this invention to provide a tool removably securable at a threaded ball joint stud for extracting a stud locating bushing mounted in a bore in an axle housing, the tool comprising a ball joint stud mountable support having an external threaded surface, and an extractor assemblage receiving the support therethrough and having a threaded portion engagable at the external threaded surface of the support and a bushing engaging portion rotatable relative to the support.

It is still another object of this invention to provide a tool removably securable at a threaded ball joint stud for extracting a threaded stud locating bushing mounted in a bore in an axle housing, the tool comprising a ball joint stud mountable support having internal and external threaded surfaces, the internal threaded surface adapted for receiving the ball joint stud, engaging means configured for engagability with the threaded bushing and having an opening for receipt therethrough of the support, the engaging means rotatable relative to the support, and securing means having a threaded portion engagable with the external threaded surface of the support for securing engagement of the engaging means with the threaded bushing during rotation of the engaging means, the threaded portion of the securing means and the external threaded surface of the support having a thread pitch selected to substantially match thread pitch of the threaded bushing to be extracted.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
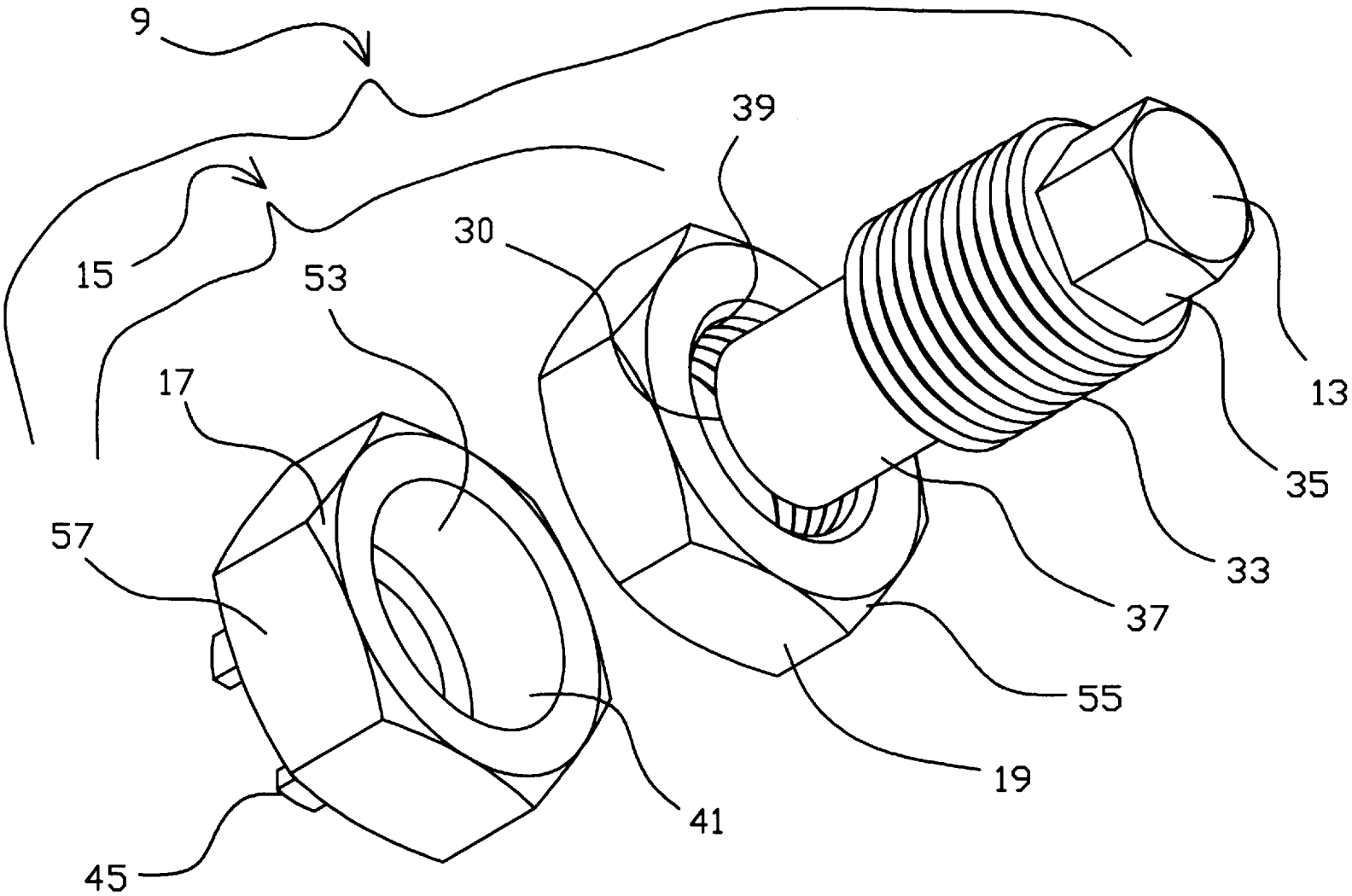
FIG. 1 is a perspective view of the tool of this invention.

Turning now to the FIGURES, tool 9 of this invention for manipulating (installing or extracting) threaded bushing 11 includes stabilizing support 13 and extractor assemblage 15. Extractor assemblage 15 includes bushing engaging spanner 17 and securing nut 19 for securing engagement of spanner 17 at bushing 11 during manipulation (rotation) of spanner 17 and thus bushing 11.

Tool 9 is particularly adapted for use on a ball joint stud locating bushing 11 located in threaded bore 21 in axle housing 23. Such bushings locate and hold a threaded upper ball joint stud 25 of ball joint assembly 27 in axle housing 23 (together with a ball joint cotter pin and castle nut—not shown—mounted on stud 25 as is known to those skilled in the art).

Stabilizing support 13 has internal threaded surface 29 extending from open end 30 adapted for mounting to a particular thread pattern 31 of a stud 25 (means other than threaded mounting, so long as adapted for stable location of support 13 on stud 25, could be utilized, however). External threaded surface 33 adjacent to closed end 35 and unthreaded external surface 37 between surface 33 and open end 30 are provided to operatively mate with opening surfaces 39 (threaded) and 41 (unthreaded), respectively, of securing nut 19 and spanner 17.

Figure 2:
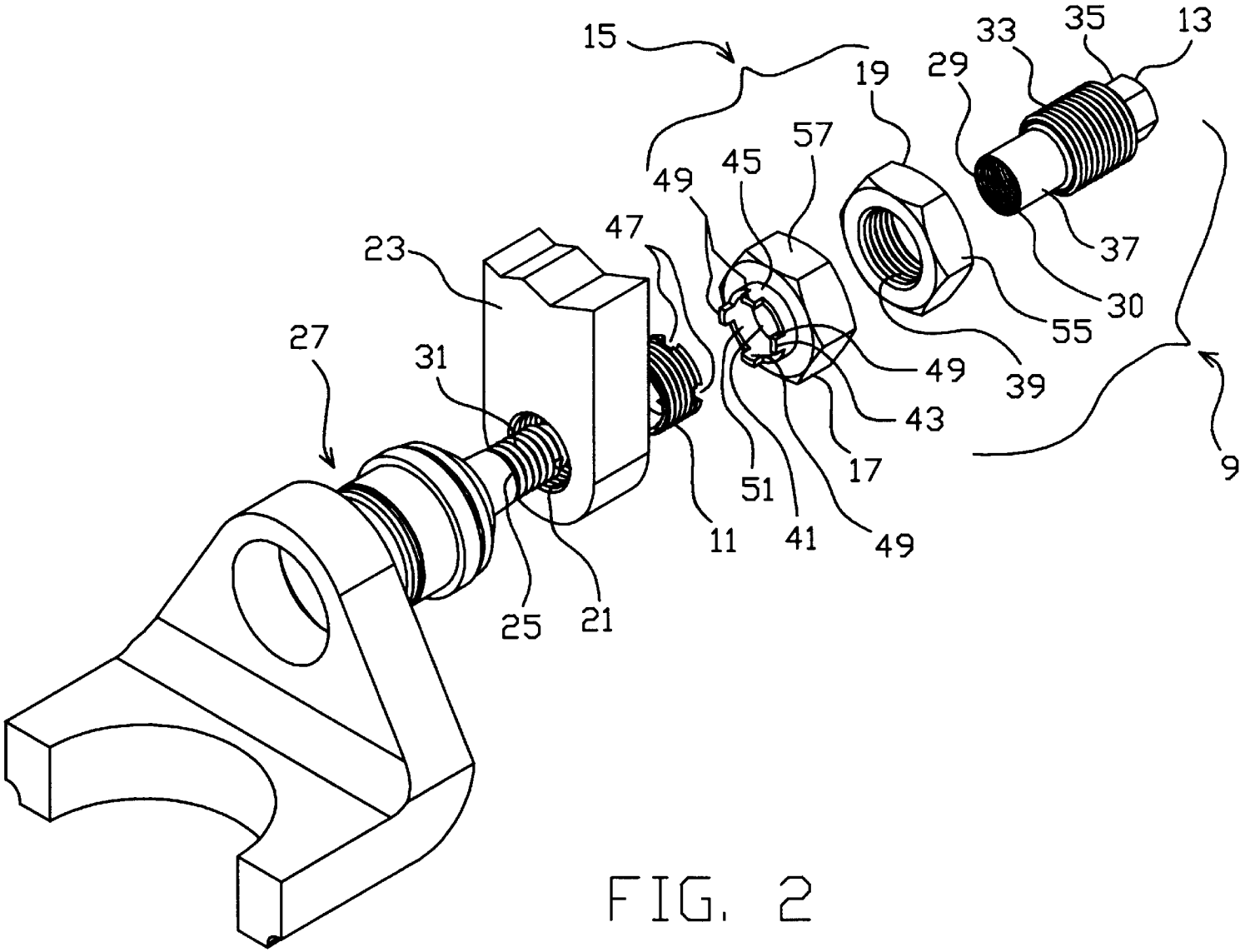
FIG. 2 is an exploded view of the tool of this invention and showing the arrangement of the bushing to be extracted and its environment.
Figure 3:
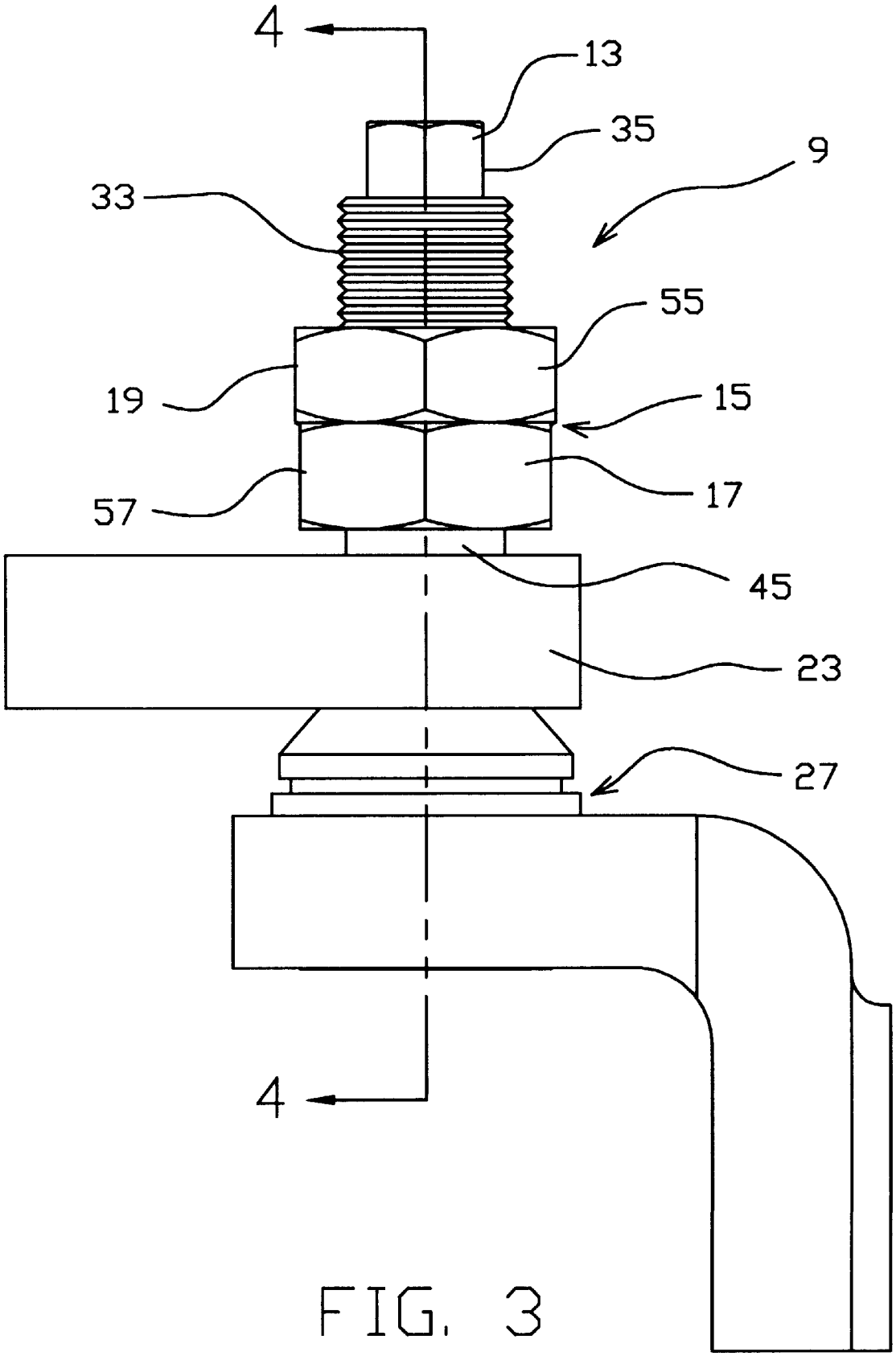
FIG. 3 is a side elevation view of the tool of this invention mounted on a ball joint stud adjacent to an axle housing having a threaded bushing therein to be extracted.

Spanner 17 is provided with an appropriate circumferential bushing engaging arrangement 43 at end portion 45, the arrangement selected depending upon the particular configuration of a particular bushing 11. Typically, such bushings include circumferentially arranged slots 47 at one end (usually 4 equally spaced slots) provided for installation and extraction tool engagement. In such cases, and as illustrated in FIG. 2, engaging arrangement 43 of tool 11 includes correspondingly positioned projections 49 (this arrangement could easily be reversed, and or any other engaging arrangement provided depending upon the configuration of the bushing to be manipulated by the tool).

Figure 4:
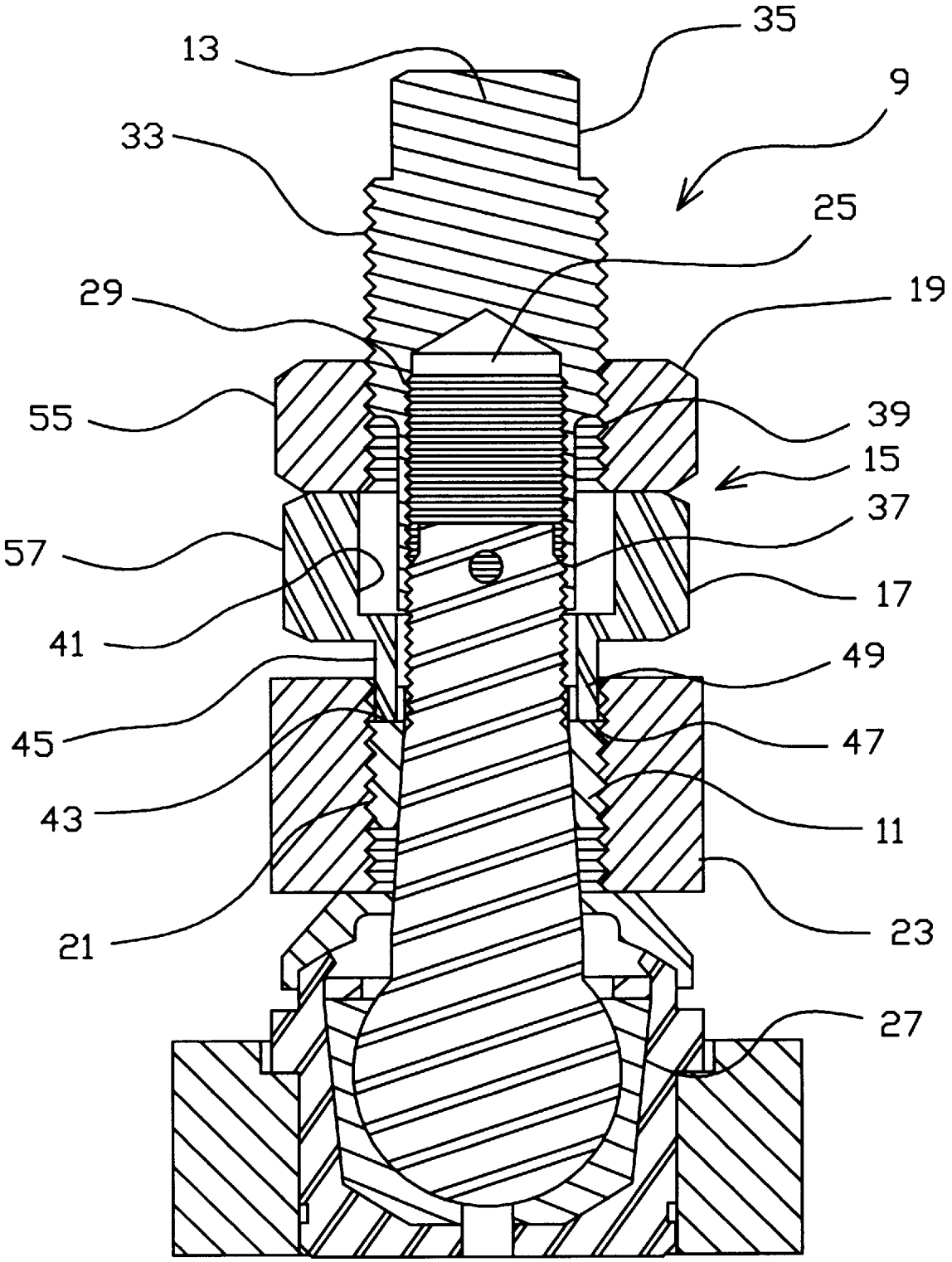
FIG. 4 is a sectional view taken along section line 4—4 of FIG. 3.

Interior opening surface 41 of spanner 17 is defined by two different bore diameter segments 51 and 53. Support open end 30 and spanner end portion 45 must both have diameters smaller than the diameter of threaded bore 21 in axle housing 23. Spanner end portion 45 outside diameter is selected to accommodate free movement thereof into and out of a particular bore 21 and support end 30 outside diameter is selected to accommodate sliding and rotating movement relative to opening surface 41 at bore segment 51 of spanner 17 (as shown in FIG. 4). Bore segment 51 thus has a diameter only marginally greater than the outside diameter of support end 30, while bore segment 53 has a diameter only marginally greater than the diameter of support 13 at external threaded surface 33 (and is thus larger than bore segment 51). In this way, external threaded surface 33 of support 13 is never directly engaged by interior surface 41 at bore segment 53 of spanner 17, spanner 17 being held in place by the snug, but slidable, relationship of support surface 37 relative to surface 41 at bore segment 51 of spanner end portion 45.

Support closed end 35, outer surface 55 of securing nut 19, and body portion 57 having bore segment 53 of spanner 17 thereat are all configured for engagement by a selected subsidiary tools (a wrench, channel locks, pliers, or the like) utilized to mount and end operation of tool 9. While hex head configurations are shown in the FIGURES to provide for subsidiary tool engagement, any of the many other known configurations suitable to the operation could be utilized.

The thread pitch of external threaded surface 33 of support 13 and securing nut threaded surface 39 are selected to substantially match the thread pitch of the particular bushing 11 to be manipulated. In operation, this match will allow linear movement of securing nut 19 on support 13 to match linear movement of bushing 11 relative to bore 21.

In operation, for example in extracting a bushing 11 from axle housing bore 21, after the ball joint cotter pin and castle nut are removed, spanner 17 is positioned over ball joint stud 25 and to the top of axle housing 23. Engaging arrangement 43 (such as projections 49) at end portion 45 of spanner 17 is engaged at the mating array of bushing 11 (such as slots 47) to be extracted. Support 13 is then mounted (threaded) on stud 25 with unthreaded external surface 37 sliding inside bore segment 51 of spanner 17 thereby providing a stable support and location adjacent to bushing 11. Securing nut 19 is threaded onto support 13 and down against body 57 of spanner 17, thus securing spanner engagement with bushing 11 (i.e., assuring that projections 49 cannot cam out of engagement with slots 47).

A subsidiary tool (i.e., a wrench) is engaged with spanner body portion 57 to rotate spanner 17. As spanner 17 is rotated to extract the bushing, spanner 17 and securing nut 19 are displaced linearly relative to support 13 (i.e., securing nut 19 carried on thread interface 39/33 and spanner 17 remaining clamped between bushing 11 and nut 19) at the same rate as bushing 11 is linearly displaced relative to bore 21 by rotation (due to the thread pitch matching as described above). In this way, engagement of bushing 11 by spanner 17 is maintained during the entire removal process without reliance upon engagement force being applied by the user of the tool during removal of bushing 11.

What is claimed is:

1. A tool for manipulating, at a threaded bore in a housing, a threaded bushing for locating a ball joint stud, said tool comprising:

a support having a threaded portion and an internal surface adapted for engagement with the ball joint stud to thus stabilize said tool adjacent to the bushing;

engaging means configured for engagability with the threaded bushing and having an opening for receipt therethrough of said support; and securing means having a threaded portion engagable with said threaded portion of said support for securing engagement of said engaging means with the threaded bushing during manipulation of the threaded bushing.

2. The tool of claim 1 wherein said engaging means includes one of spaced projections and spaced slots at one end thereof configured for engaging the threaded bushing.

3. The tool of claim 1 wherein said engaging means includes first and second portions, said first portion having an outside diameter selected to accommodate freedom of movement into and out of the threaded bore in the housing, and said second portion configured for subsidiary tool engagement.

4. The tool of claim 1 wherein said threaded portions of said securing means and said support have a thread pitch selected to substantially match thread pitch of the threaded bushing to be manipulated.

5. The tool of claim 1 wherein said securing means includes an outer surface shaped to accommodate subsidiary tool engagement.

6. A tool removably securable at a threaded ball joint stud for extracting a stud locating bushing mounted in a bore in a housing, said tool comprising:

a ball joint stud mountable support having an external threaded surface and an end; and an extractor assemblage receiving said support therethrough and having a threaded portion engagable at said external threaded surface of said support and a bushing engaging portion having an end and being rotatable relative to said support, said support end and said engaging portion end each having diameters selected to be less than diameter of the bore having the bushing to be extracted therein.

7. The tool of claim 6 wherein said support includes an internal threaded surface configured for engagability with the threaded ball joint stud.

8. The tool of claim 7 wherein said support has an open end to said internal threaded surface and a closed end, said closed end configured for engagement by a subsidiary tool.

9. The tool of claim 6 wherein said support end diameter is less than said diameter of said engaging portion end.

10. A tool removably securable at a threaded ball joint stud for extracting a threaded stud locating bushing mounted in a bore in a housing, said tool comprising:

a ball joint stud mountable support having internal and external threaded surfaces, said internal threaded surface adapted for receiving the ball joint stud;

engaging means configured for engagability with the threaded bushing and having an opening for receipt therethrough of said support, said engaging means rotatable relative to said support; and securing means having a threaded portion engagable with said external threaded surface of said support for securing engagement of said engaging means with the threaded bushing during rotation of said engaging means, said threaded portion of said securing means and said external threaded surface of said support having a thread pitch selected to substantially match thread pitch of the threaded bushing to be extracted.

11. The tool of claim 10 wherein said external threaded surface of said support is adjacent to one end of said support and wherein said support has an unthreaded external surface between said external threaded surface and an opposite end of said support.

12. The tool of claim 11 wherein said opening through said engaging means includes first and second segments, said first segment having a first diameter sufficient to receive said support with said external threaded surface therethrough, and said second segment having a diameter smaller than said first segment and sufficient to receive said support with said unthreaded external surface therethrough.

13. The tool of claim 12 wherein said engaging means includes first and second portions, said second segment of said opening located at said first portion, said first portion having an outside diameter selected to accommodate freedom of movement into and out of the bore in the housing, and said first segment of said opening located at said second portion, said second portion configured for subsidiary tool engagement.

14. The tool of claim 11 wherein said engaging means has an unthreaded inner surface at said opening, said unthreaded surfaces of said support and said engaging means positioned to oppose one another when said tool is in use.

15. The tool of claim 10 wherein said engaging means includes one of spaced projections and spaced slots arranged circumferentially at one end thereof and configured for engaging the threaded bushing.

* * * * *